US009038314B2

(12) United States Patent
Chen

(10) Patent No.: US 9,038,314 B2
(45) Date of Patent: May 26, 2015

(54) APPARATUS FOR CONTROLLING SLATS OF SASH

(71) Applicant: NIEN MADE ENTERPRISES CO., LTD., Taichung (TW)

(72) Inventor: Lin Chen, Taichung (TW)

(73) Assignee: NIEN MADE ENTERPRISES CO., LTD., Taichung (TW)

( * ) Notice: Subject to any disclaimer, the term of this patent is extended or adjusted under 35 U.S.C. 154(b) by 0 days.

(21) Appl. No.: 14/301,843

(22) Filed: Jun. 11, 2014

(65) Prior Publication Data

US 2015/0020452 A1 Jan. 22, 2015

(30) Foreign Application Priority Data

Jul. 16, 2013 (CN) ..... 2013 2 0422356 U

(51) Int. Cl.
*E06B 7/096* (2006.01)

(52) U.S. Cl.
CPC ..... *E06B 7/096* (2013.01)

(58) Field of Classification Search
CPC ..... E06B 7/096
USPC ..... 49/81.1, 74.1, 82.1
See application file for complete search history.

(56) References Cited

U.S. PATENT DOCUMENTS 234,317 A * 11/1880 Monk ..... 49/82.1
235,151 A * 12/1880 Janssen ..... 49/82.1
2,281,071 A * 4/1942 Knudsen ..... 49/64
2,974,763 A * 3/1961 Vuncannon ..... 49/82.1
3,201,832 A * 8/1965 Hordis et al. ..... 49/64
4,860,492 A * 8/1989 Roy ..... 49/82.1
6,568,131 B1 * 5/2003 Milano, Jr. ..... 49/82.1
6,701,669 B1 * 3/2004 Yorgason ..... 49/82.1
7,434,353 B2 * 10/2008 Nien et al. ..... 49/82.1
2005/0252086 A1 * 11/2005 Yorgason ..... 49/82.1
2005/0257429 A1 * 11/2005 Yorgason ..... 49/82.1
2008/0178526 A1 * 7/2008 Browne et al. ..... 49/82.1
2008/0250717 A1 * 10/2008 Vasquez ..... 49/74.1
2009/0149123 A1 * 6/2009 Blagg ..... 454/258
2013/0118082 A1 * 5/2013 Colson ..... 49/82.1
2014/0033610 A1 * 2/2014 Watkins et al. ..... 49/82.1
2014/0166219 A1 * 6/2014 Chen ..... 160/368.1

* cited by examiner

*Primary Examiner* — Jerry Redman

(74) *Attorney, Agent, or Firm* — Ming Chow; Sinorica, LLC

(57) ABSTRACT

An adjusting apparatus is provided in a sash to turn slats automatically while the sash is being opened. The adjusting apparatus includes a plurality of first engaging members, a driven unit, and a driving unit. The first engaging members are connected to the slats respectively. The driven unit is connected to the frame of the sash for reciprocation, and has a second engaging member, wherein all the first engaging members are engaged with the second engaging member. The driving unit is connected to the carrier and the driven unit respectively to drive the driven unit to move while the sash is being opened. The first engaging members are turned by the second engaging member when the driven unit is moved by the driving unit to turn the slats from the first position to the second position.

13 Claims, 13 Drawing Sheets

APPARATUS FOR CONTROLLING SLATS OF SASH

The current application claims a foreign priority to the patent application of China No. 201320422356.5 filed on Jul. 16, 2013.

BACKGROUND OF THE INVENTION

1. Technical Field

The present invention relates to a sash of a window or door, and more particularly to an apparatus for controlling slats of a sash.

2. Description of Related Art

A conventional sash includes a frame and a plurality of parallel slats pivotally connected to the frame. The slats are able to be turned between a vertical position and a horizontal position just like a window blind.

In the prior arts, some sashes provide the frame pivoted on the wall, so that the whole sash is able to be opened and closed. However, while the slats are tuned to the horizontal position and the sash is being opened, the edges of the slats may hit the wall and get damaged. This problem is unsolved until now.

BRIEF SUMMARY OF THE INVENTION

In view of the above, the primary objective of the present invention is to provide an apparatus for adjusting slats of a sash, which may automatically turn the slats to the second position (vertical position) while the sash is being opened.

In order to achieve the objective of the present invention, the present invention provides an adjusting apparatus for adjusting slats of a sash while the sash is opened. The sash is pivotally connected to a carrier and has a frame, and the slats are pivotally connected to the frame to be turned between a first position and a second position. The adjusting apparatus includes a plurality of first engaging members, a driven unit, and a driving unit. The first engaging members are connected to the slats respectively. The driven unit is connected to the frame of the sash for reciprocation, and has a second engaging member, wherein all the first engaging members are engaged with the second engaging member. The driving unit is connected to the carrier and the driven unit respectively to drive the driven unit to move while the sash is being opened. The first engaging members are turned by the second engaging member when the driven unit is moved by the driving unit to turn the slats from the first position to the second position.

In an embodiment, the driven unit includes a movable member connected to the second engaging member; the driving unit includes a pushing member and a driving member; the driving member is connected to the frame of the sash and the carrier respectively; the driving member is moved when the sash is being opened, the pushing member is moved by the driving member, and the movable member is moved by the pushing member to generate a relative movement between the second engaging member and the first engaging members to turn the slats.

In an embodiment, the driving unit further includes a base embedded in the frame of the sash; the base has a cavity, in which the pushing member is received for reciprocation, and the driving member is connected to the base.

In an embodiment, the driving unit further includes a biasing member which is deposed in the cavity of the base and urges the pushing member in a direction opposite to that of the pushing member being moved by the driving member.

In an embodiment, the driving member further includes a lateral board and a first roller; the lateral board is connected to the base to cover the cavity, and has an opening communicated with the cavity; the first roller is received in the cavity and pivotally connected to the base; the base has a top board, and the biasing member has opposite ends urging the top board and the pushing member respectively; the driving member has an end fastened to the top board; the driving member runs around the pushing member and the first roller, and then extends out of the base via the opening of the lateral board to be fastened to the carrier.

In an embodiment, the pushing member has a lid and a second roller pivotally connected to the lid, and the driving member runs around the second roller.

In an embodiment, the first roller and/or the second roller has a groove, in which the driving member is received.

In an embodiment, the base is provided with a guiding slot; the movable member is provided with a protrusion to be engaged with the guiding slot, and the movable member moves along the guiding slot.

In an embodiment, the driven unit includes a movable member connected to the second engaging member; the driving unit includes a pushing member and a driving member; the driving member is connected to the pushing member and the carrier respectively; the driving member is moved when the sash is being opened, the pushing member is moved by the driving member, and the movable member is moved by the pushing member to generate a relative movement between the second engaging member and the first engaging members to turn the slats.

In an embodiment, the driving unit further includes a biasing member which urges the pushing member in a direction opposite to that of the pushing member being moved by the driving member.

In an embodiment, the driving unit further includes a base, a lateral board, and a first roller; the base is embedded in the frame of the sash; the base has a cavity, in which the pushing member is received for reciprocation; the lateral board is connected to the base to cover the cavity, and has an opening communicated with the cavity; the first roller is received in the cavity and pivotally connected to the base; the driving member runs around the first roller, and then extends out of the base via the opening of the lateral board to be fastened to the carrier.

In an embodiment, the base is provided with a guiding slot; the movable member is provided with a protrusion to be engaged with the guiding slot, and the movable member moves along the guiding slot.

With such design, the slats of the sash will be turned to the second position (vertical position) automatically while the sash is being opened to prevent the slats from hitting the wall.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
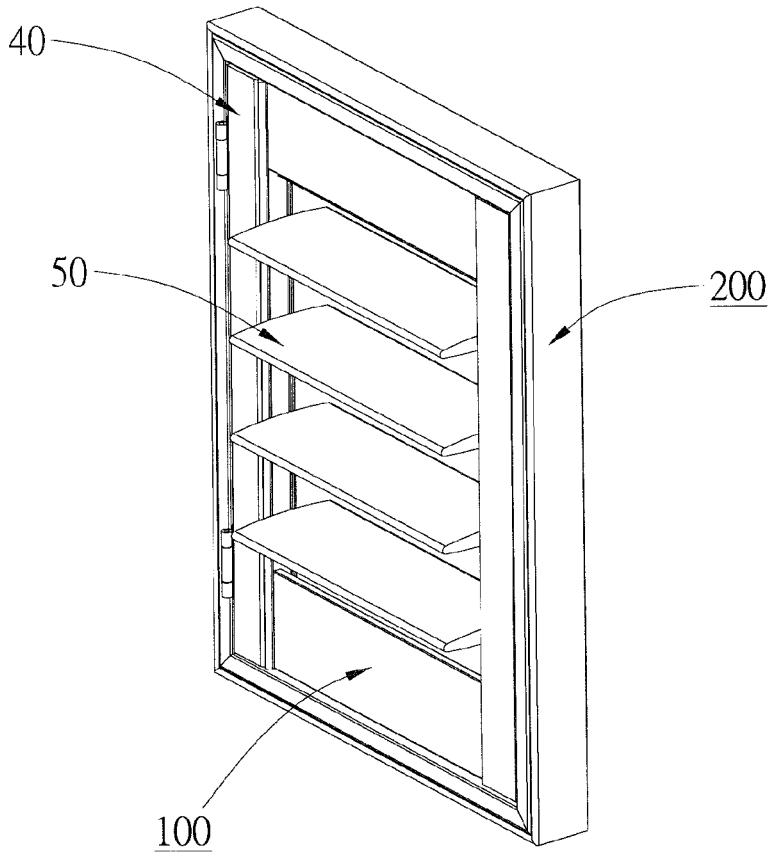
FIG. 1 is a perspective view of a first preferred embodiment of the present invention, shown that the sash is closed and the slats are at the first position.
Figure 2:
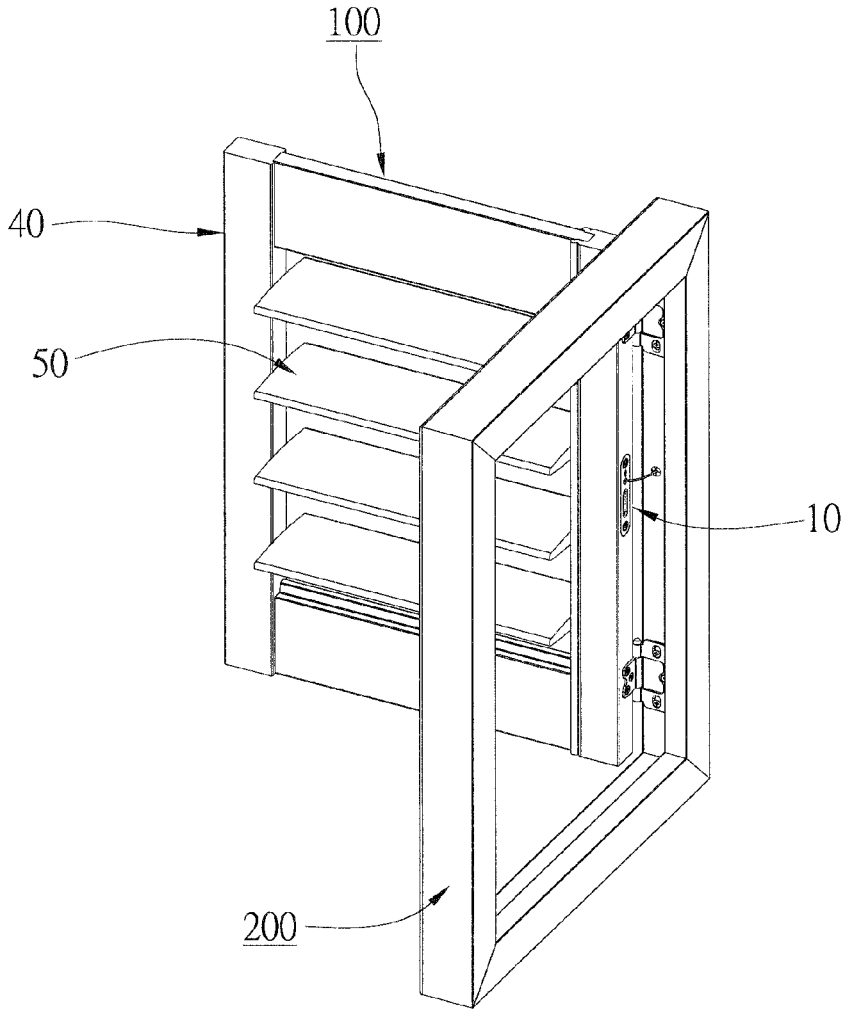
FIG. 2 is a perspective view of the first preferred embodiment of the present invention, showing that the sash is being opened and the slats are at the first position.
Figure 3:
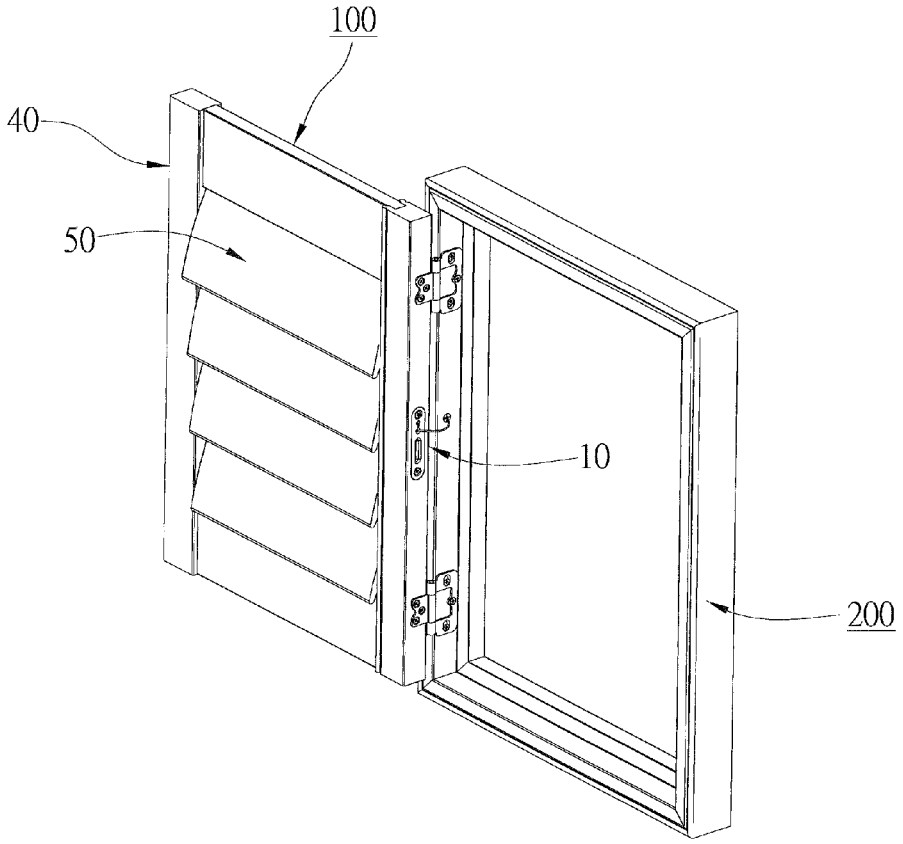
FIG. 3 is a perspective view of the first preferred embodiment of the present invention, showing that the sash is opened and the slats are at the second position.

As shown in FIG. 1 to FIG. 3, a sash 100 of the first preferred embodiment of the present invention includes a frame 40 and a plurality of parallel slats 50. The frame 40 is a rectangular board with a rectangular opening at a center thereof. The slats 50 are received in the opening of the frame 40, and have their opposite ends pivoted on the frame 40, so that each slat 50 is able to be turned. The frame 100 is hinged with a sash frame 200, therefore the sash 100 could be closed (FIG. 1) and opened (FIG. 2).

Figure 4:
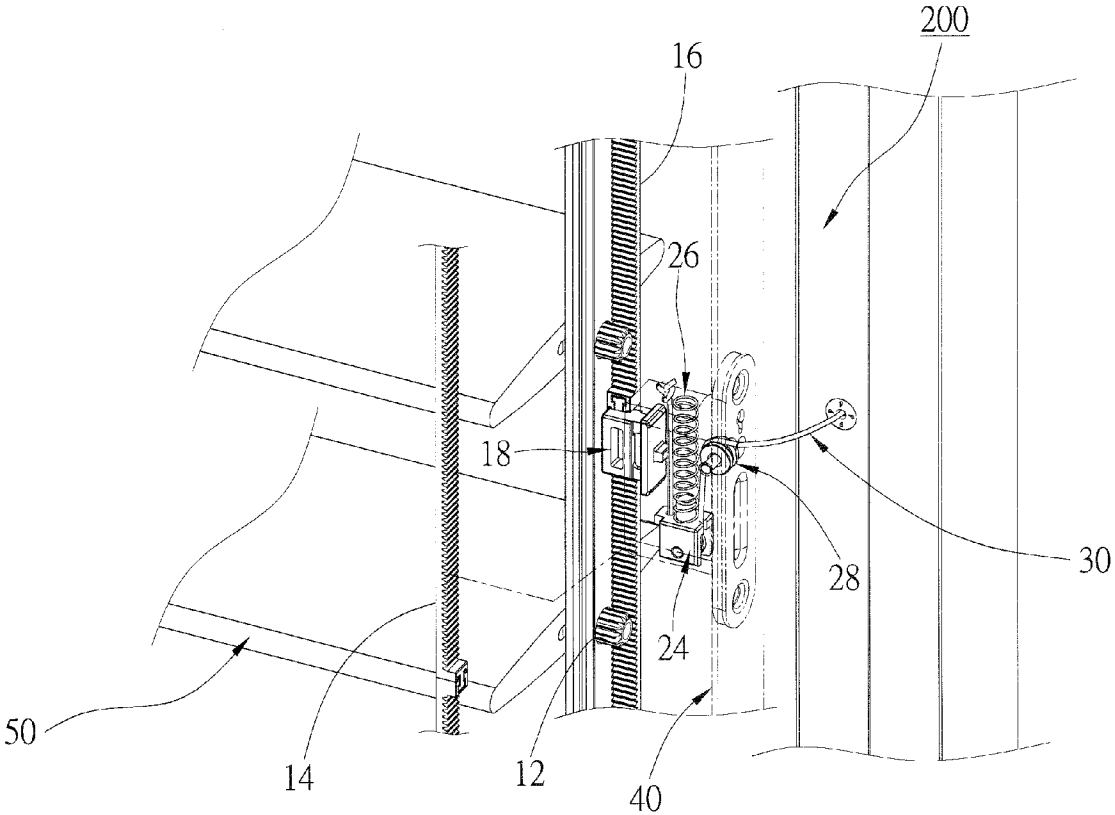
FIG. 4 is a perspective view of the adjusting apparatus of the first preferred embodiment of the present invention.
Figure 5:
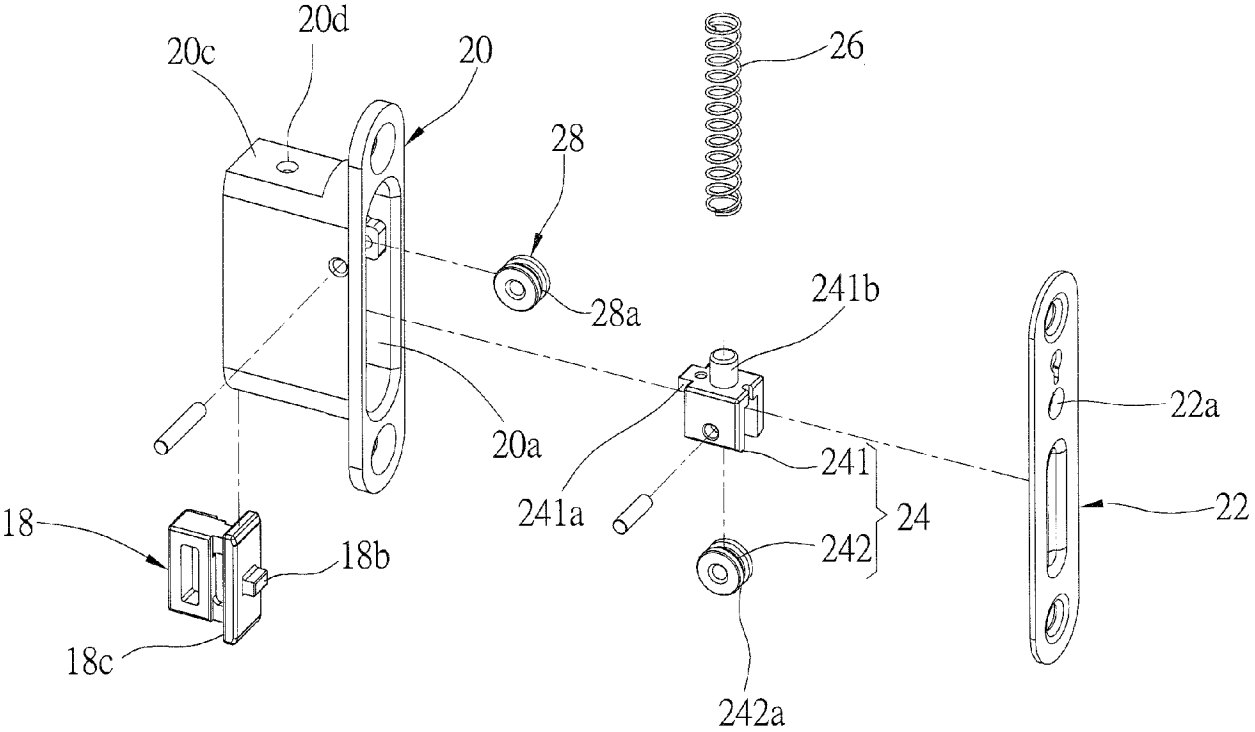
FIG. 5 is an exploded view of the adjusting apparatus of the first preferred embodiment of the present invention.
Figure 6:
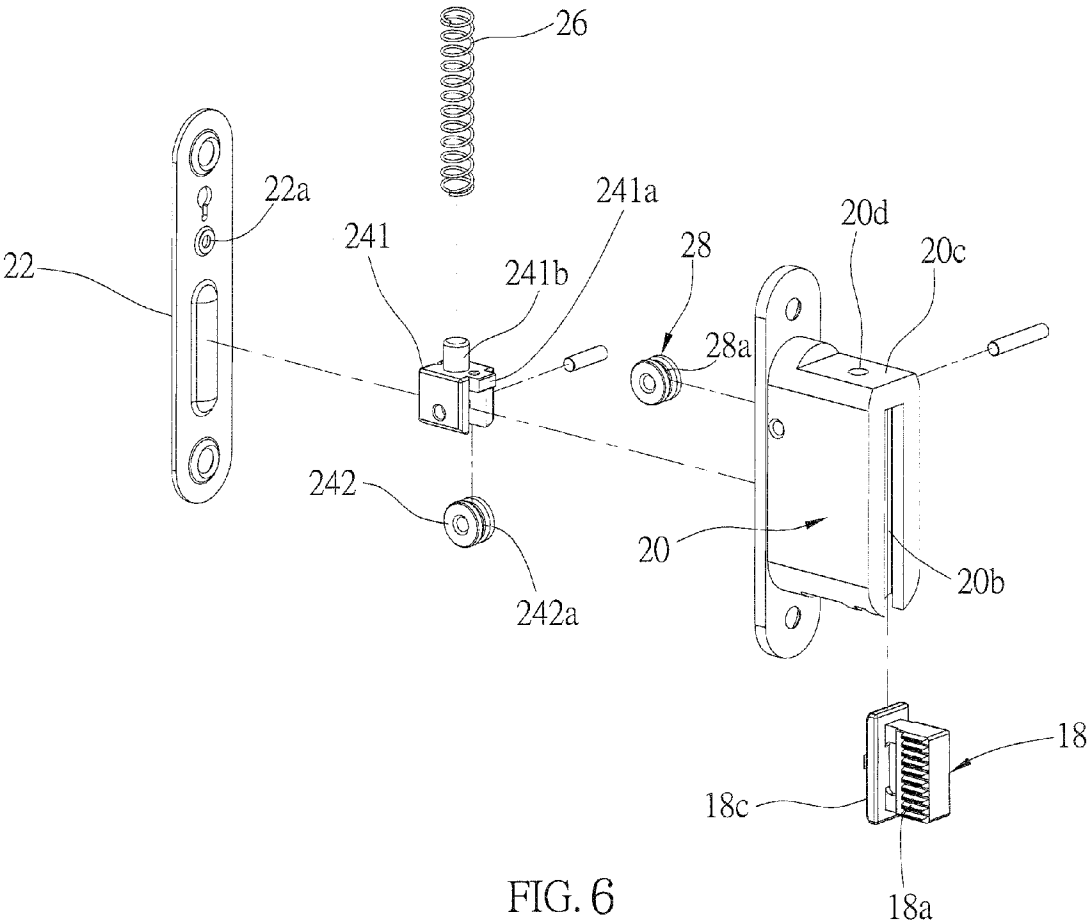
FIG. 6 is another exploded view of the adjusting apparatus of the first preferred embodiment of the present invention.

The sash 100 further is provided with an adjusting apparatus 10. As shown in FIG. 4, the adjusting apparatus 10 has a plurality of first engaging members, a driven unit, and a driving unit. In the first preferred embodiment, the first engaging members are gears 12 fixed to an end of each slat 50. The driven unit is received in the frame 40 for reciprocation. The driven unit has a second engaging member and a movable member 18. In the first preferred embodiment, the adjusting apparatus 10 further has a third engaging member, and the third engaging member is a rack 14 fixed to the frame 40. The second engaging member is a rack 16 as well, and the rack 16 of the second engaging member is parallel to the rack 14 of the third engaging member, and the gears 12 are meshed with both the racks 14, 16 at the same time. As shown in FIG. 5 and FIG. 6, the movable member 18 is provided with teeth 18*a* to be meshed with the rack 16. The movable member 18 further has a first block 18*b* at a side thereof. In another embodiment, the movable member 18 and the second engaging member are directly connected together or made into a single unit instead of meshed with together. No matter what kind of it, the movable member 18 and the second engaging member should move together.

The driving unit is connected to the sash frame 200 (so called carrier hereafter) and the driven unit respectively. The driving unit has a base 20, a lateral board 22, a biasing member, a first roller 28, and a driving member 24. The biasing member is a spring 26, and the driving member is a cord 30 in the first preferred embodiment. The base 20 is embedded in the frame 40, and has a cavity 20*a*, which is open at a front end of the base 20. The lateral board 22 is attached to the front side of the base 20 to cover an exterior end of the cavity 20*a*. The lateral board 22 has an opening 22*a*, which is communicated with the bore 20*a*. The base 20 is provided with a guiding slot 20*b* at a rear side thereof, and the guiding slot 20*b* is communicated with an interior end of the cavity 20*a*. The movable member 18 is provided with a protrusion 18*c* engaging the guiding slot 20*b* to allow the movable member 18 to move along the guiding slot 20*b*. The first block 18*b* is on the protrusion 18*c* and is received in the cavity 20*a* while the movable member 18 is engaged with the base 20. The pushing member 24, the spring 26, and the first roller 28 are received in the cavity 20*a* of the base 10 and between the lateral board 22 and the movable member 18.

As shown in FIG. 5, the pushing member 24 includes a lid 241 and a second roller 242 pivotally connected to the lid 241. The lid 241 is provided with a second block 214*a* and a rod 241*b*. The spring 26 is fitted to the rod 241*b* and urges a top board 20*c* of the base 20 to urge the pushing member 24 downwards. The first roller 28 is pivotally connected to the base 20 and adjacent to the opening 22*a* of the lateral board 22.

The cord 30 has a predetermined length, and has an end passing through an opening 20*d* on the top board 20*c* of the base 20 and tied a knot to fasten the cord 30 to the top board 20*c*. The cord 30 runs around the second roller 242 and the first roller 28 in sequence, and then passes through the opening 22*a* of the lateral board 22 to be fastened to the sash frame 200. The first roller 28 and the second roller 242 are respectively provided with a groove 28*a* (242*a*) to receive the cord 30 therein.

Figure 7:
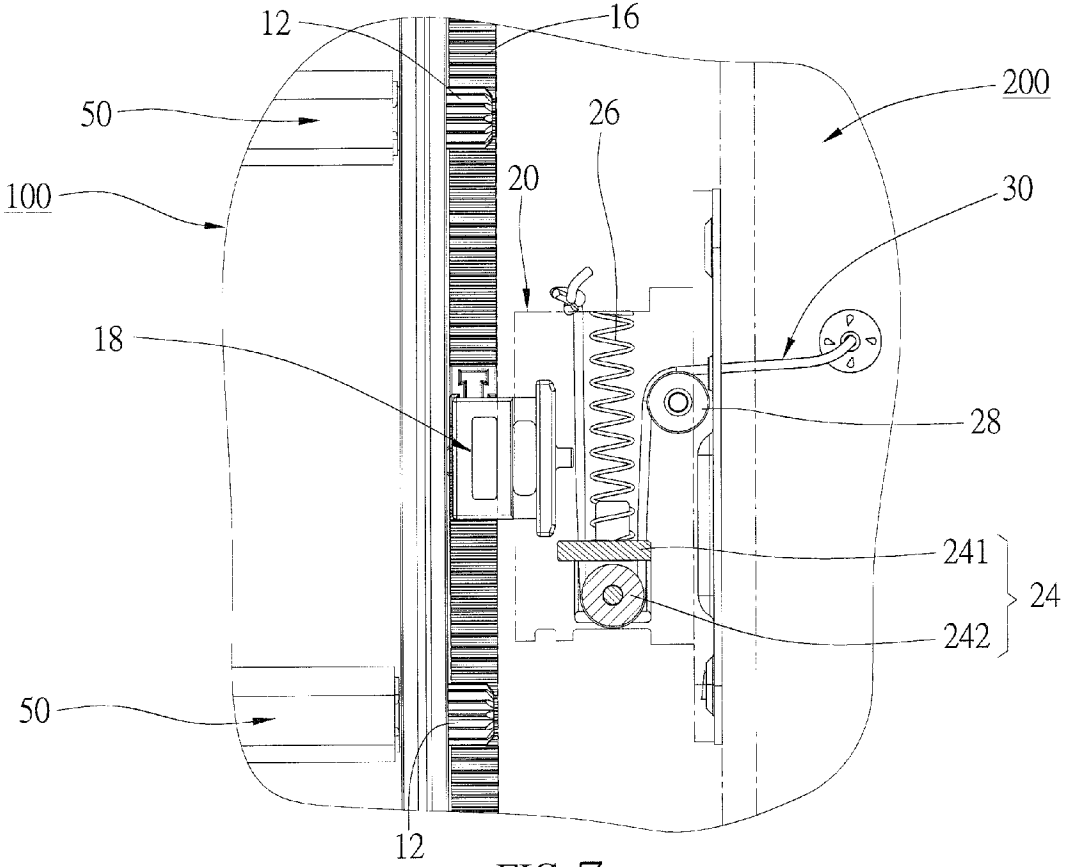
FIG. 7 to FIG. 9 are lateral views of the first preferred embodiment of the present invention, showing the pushing member at different levels.
Figure 8:
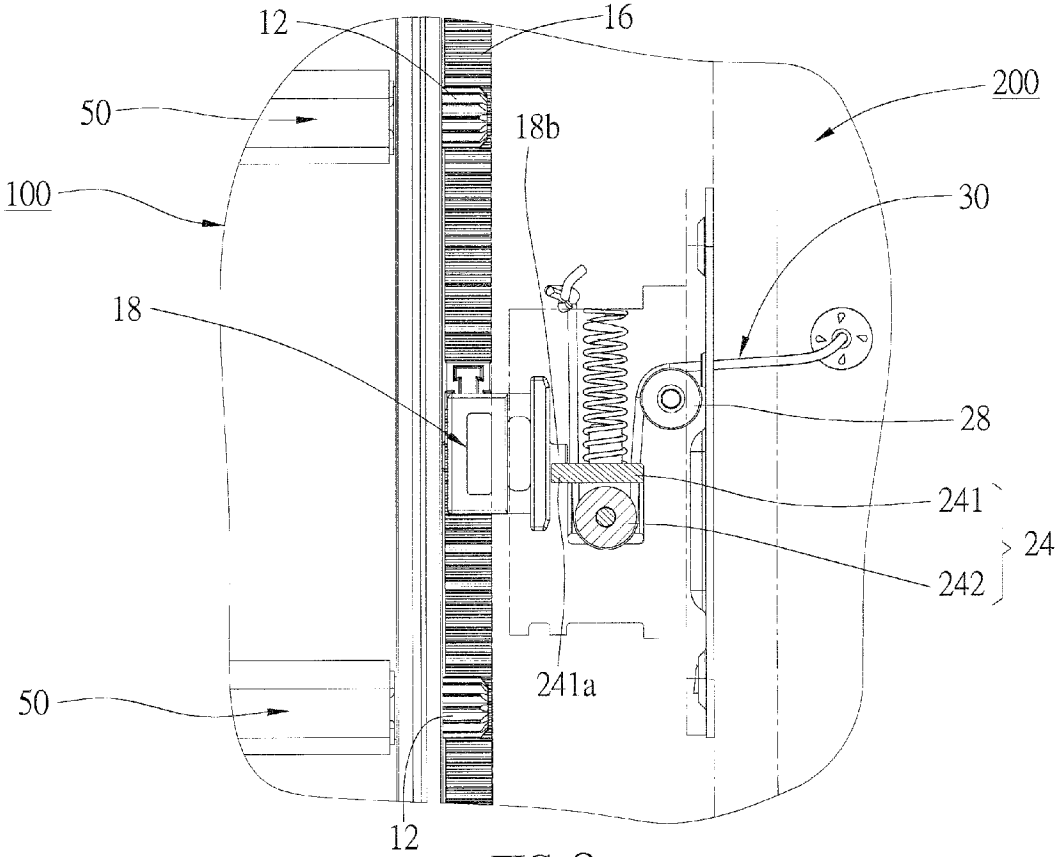

The sash 100 is hinged with the sash frame 200 to be opened and closed. The slats 50 are adjustable to be turned between a first position, in which the slats 50 are substantially horizontal to let the sun and air passing through, and a second position, in which the slats 50 are substantially vertical to shade the sun. While the sash 100 is closed, we usually turn the slats 50 to the first position (FIG. 1), and while the sash 100 is being opened, the slats 50 will be turned to the second position automatically (FIG. 3). While the sash 100 is closed, as shown in FIG. 7, the spring 26 is uncompressed, and the pushing member 24 is located at the lowest position. Next, when the sash 100 is being opened, the sash 100 is turned related to the sash frame 200 to enlarge a distance therebetween. Consequently, the cord 30 will be stretched to move the pushing member 24 upwards until the second block 241*a* of the lid 241 touches the first block 18*b* of the movable member 18 (FIG. 8). The slats 50 stay in the first position until now.

Figure 9:
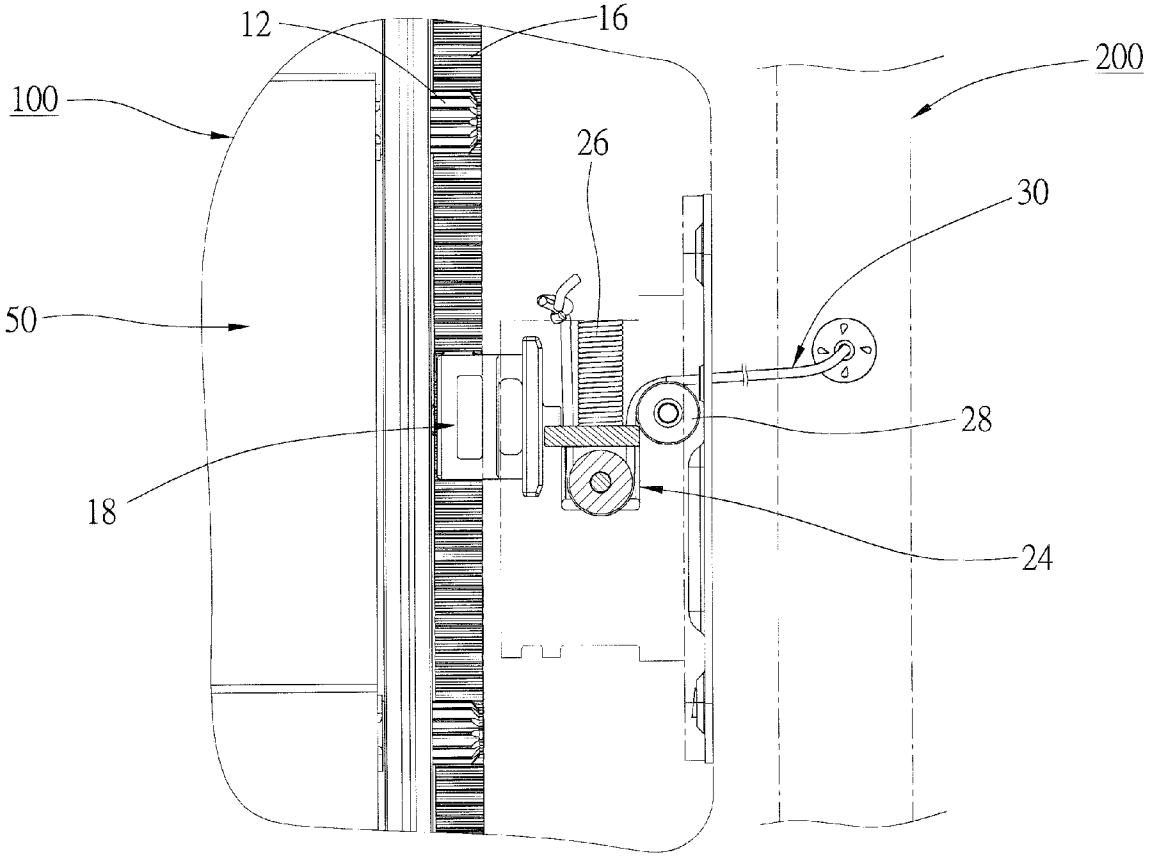

While the sash 100 is continuously being opened, the movable member 18 is being moved upwards by the cord 30, and the rack 16, which is engaged with the movable member 18, are moved together with the movable member 18. With the movement of the rack 16, it will turn the gears 12 so as to turn the slats 50 to the second position (FIG. 9). The slats 50 are turned to the second position before the sash 100 is totally opened to prevent the opened slats 50 from hitting the wall.

Figure 10:
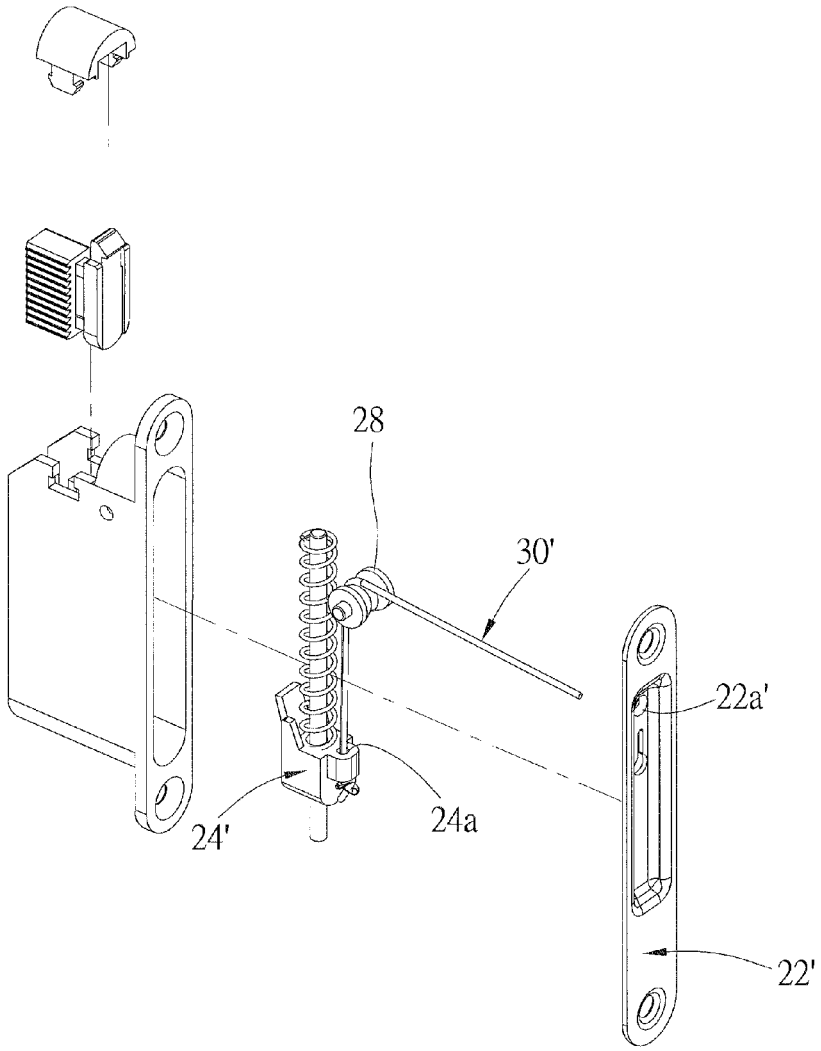
FIG. 10 is an exploded view of a second preferred embodiment of the present invention, showing some elements of the adjusting apparatus.
Figure 11:
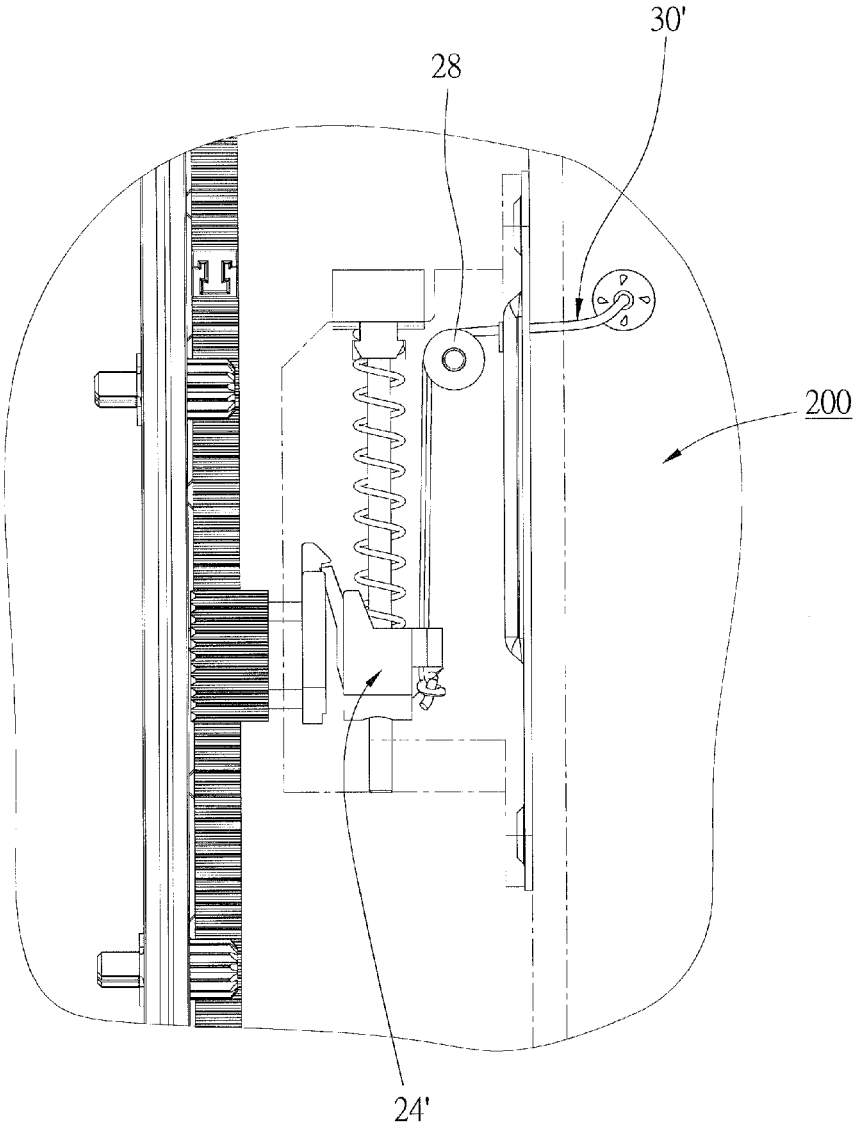
FIG. 11 is a lateral view of the second preferred embodiment of the present invention, showing the relationship of the elements of the adjusting apparatus.

In the first preferred embodiment, the cord 30 has its opposite end connected to the sash frame 200 and the base 20 to move the driven unit, and there still are some other ways to drive the driven unit. FIG. 10 and FIG. 11 show the second preferred embodiment of the present invention, which provides an alternate way to drive the driven unit. A pushing member 24' of the second preferred embodiment is a single element having an opening 24*a*, and an end of a cord 30' passes through the opening 24*a* and is tied a knot to fasten the cord 30' to the pushing member 24' directly. The cord 30' runs around the first roller 28, and passes through an opening 22*a*' of a lateral board 22', and then is fastened to the sash frame 200. The same as above, while the sash of the second preferred embodiment is being opened, the cord 30' will draw the pushing member 24' to move toward the movable member, and drive the rack to move to turn the slats from the first position to the second position.

Figure 12:
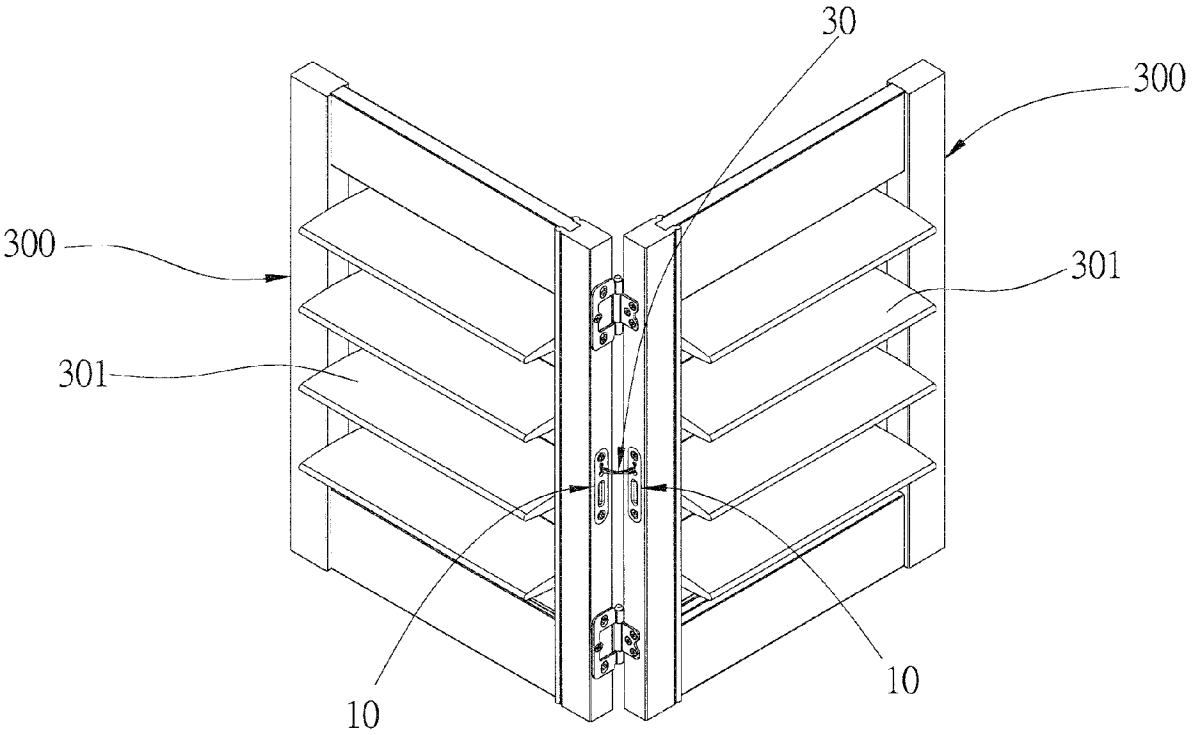
FIG. 12 and FIG. 13 are perspective views, showing that the adjusting apparatus is incorporated in the window with two sashes.
Figure 13:
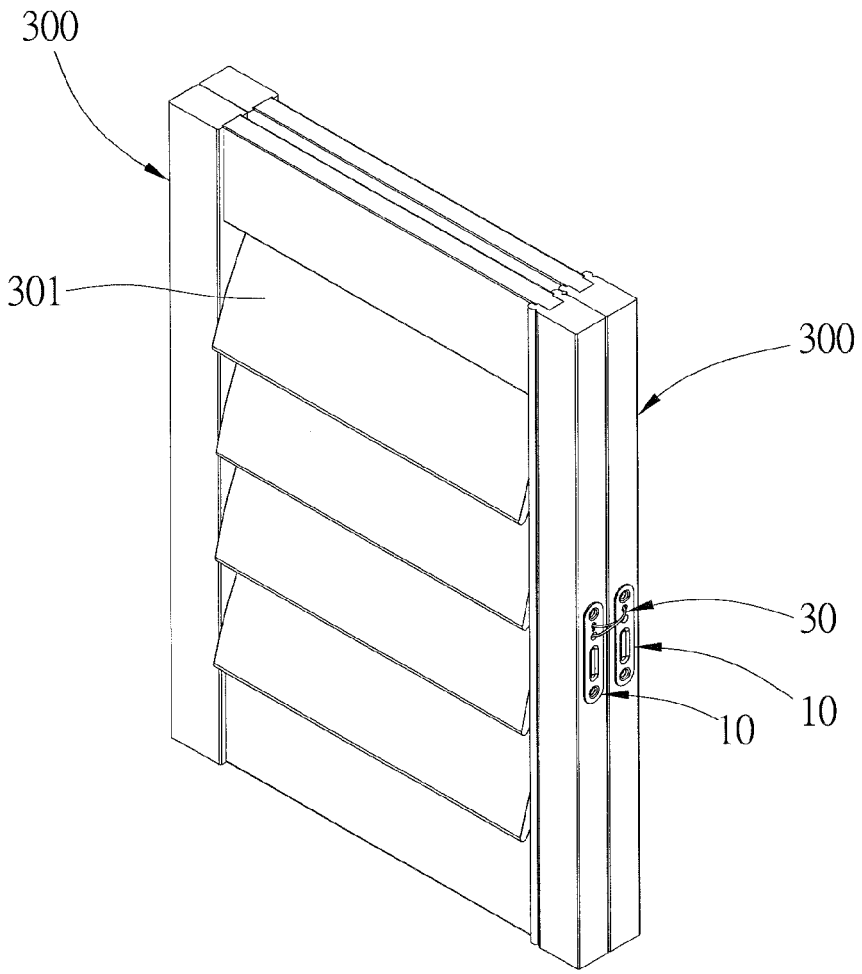

FIG. 12 shows the adjusting apparatus of the present invention incorporated in a window with two sashes 300. The sashes 300 are hinged with each other, and the adjusting apparatus 10 is mounted on one of the sashes 300, and the cord 30 is fastened to the other. Slats 301 will be turned to the second position (vertical position) automatically while the sashes 300 are folded. It is noted that the adjusting apparatus of the second preferred embodiment could be incorporated in the same window.

The first, second, and third engaging members could be any equivalent device of the gear and rack, such as gear and chain, or gear and ball chain. The adjusting apparatus of the present invention is provided to automatically turn the slats 50 to their vertical position when one closes the sash 100. Therefore, the adjusting apparatus will not work if the sash 100 is closed, and the adjusting apparatus will not turn the slats 50 if the slats 50 are already at the vertical position.

It must be pointed out that the embodiments described above are only some preferred embodiments of the present invention. All equivalent structures which employ the concepts disclosed in this specification and the appended claims should fall within the scope of the present invention.

What is claimed is:

1. An adjusting apparatus for adjusting slats of a sash while the sash is opened, wherein the sash is pivotally connected to a carrier and has a frame, and the slats are pivotally connected to the frame to be turned between a first position and a second position, comprising:

a plurality of first engaging members connected to the slats respectively;

a driven unit connected to the frame of the sash for reciprocation;

the driven unit having a second engaging member;

all the first engaging members are engaged with the second engaging member;

a driving unit connected to the carrier and the driven unit respectively to drive the driven unit to move while the sash is being opened;

wherein the first engaging members are turned by the second engaging member when the driven unit is moved by the driving unit to turn the slats from the first position to the second position; and wherein the driving unit is moved while the sash is being opened to move the driven unit, so that the slats are turned to the second position through the first engaging members and the second engaging member, whereby the slats are turned by opening the sash.

2. The adjusting apparatus of claim 1, wherein the driven unit includes a movable member connected to the second engaging member; the driving unit includes a pushing member and a driving member; the driving member is connected to the frame of the sash and the carrier respectively; the driving member is moved when the sash is being opened, the pushing member is moved by the driving member, and the movable member is moved by the pushing member to generate a relative movement between the second engaging member and the first engaging members to turn the slats.

3. The adjusting apparatus of claim 2, wherein the driving unit further includes a base embedded in the frame of the sash; the base has a cavity, in which the pushing member is received for reciprocation, and the driving member is connected to the base.

4. The adjusting apparatus of claim 3, wherein the driving unit further includes a biasing member which is deposed in the cavity of the base and urges the pushing member in a direction opposite to that of the pushing member being moved by the driving member.

5. The adjusting apparatus of claim 4, wherein the driving member further includes a lateral board and a first roller; the lateral board is connected to the base to cover the cavity, and has an opening communicated with the cavity; the first roller is received in the cavity and pivotally connected to the base; the base has a top board, and the biasing member has opposite ends urging the top board and the pushing member respectively; the driving member has an end fastened to the top board; the driving member runs around the pushing member and the first roller, and then extends out of the base via the opening of the lateral board to be fastened to the carrier.

6. The adjusting apparatus of claim 5, wherein the first roller has a groove, in which the driving member is received.

7. The adjusting apparatus of claim 5, wherein the pushing member has a lid and a second roller pivotally connected to the lid, and the driving member runs around the second roller.

8. The adjusting apparatus of claim 7, wherein the second roller has a groove, in which the driving member is received.

9. The adjusting apparatus of claim 5, wherein the base is provided with a guiding slot; the movable member is provided with a protrusion to be engaged with the guiding slot, and the movable member moves along the guiding slot.

10. The adjusting apparatus of claim 1, wherein the driven unit includes a movable member connected to the second engaging member; the driving unit includes a pushing member and a driving member; the driving member is connected to the pushing member and the carrier respectively; the driving member is moved when the sash is being opened, the pushing member is moved by the driving member, and the movable member is moved by the pushing member to generate a relative movement between the second engaging member and the first engaging members to turn the slats.

11. The adjusting apparatus of claim 10, wherein the driving unit further includes a biasing member which urges the pushing member in a direction opposite to that of the pushing member being moved by the driving member.

12. The adjusting apparatus of claim 1, wherein the driving unit further includes a base, a lateral board, and a first roller; the base is embedded in the frame of the sash; the base has a cavity, in which the pushing member is received for reciprocation; the lateral board is connected to the base to cover the cavity, and has an opening communicated with the cavity; the first roller is received in the cavity and pivotally connected to the base; the driving member runs around the first roller, and then extends out of the base via the opening of the lateral board to be fastened to the carrier.

13. The adjusting apparatus of claim 12, wherein the base is provided with a guiding slot; the movable member is provided with a protrusion to be engaged with the guiding slot, and the movable member moves along the guiding slot.

* * * * *